US007000275B2

(12) United States Patent
Matthews Brown et al.

(10) Patent No.: US 7,000,275 B2
(45) Date of Patent: Feb. 21, 2006

(54) SUPPORT PILLOW FOR SMALL INFANTS

(75) Inventors: Susan H. Matthews Brown, Evergreen, CO (US); Sheila Littlehorn, Littleton, CO (US); Clarice Bonzer, Littleton, CO (US)

(73) Assignee: The Boppy Company, Golden, CO (US)

( * ) Notice: Subject to any disclaimer, the term of this patent is extended or adjusted under 35 U.S.C. 154(b) by 22 days.

(21) Appl. No.: 11/049,332

(22) Filed: Feb. 1, 2005

(65) Prior Publication Data

US 2005/0125902 A1 Jun. 16, 2005

Related U.S. Application Data

(63) Continuation of application No. 10/612,267, filed on Jul. 1, 2003, now Pat. No. 6,857,150.

(51) Int. Cl.
*A47G 9/00* (2006.01)
*B65D 25/54* (2006.01)

(52) U.S. Cl. ..... 5/655; 5/652; 206/770

(58) Field of Classification Search ..... 5/655, 5/636, 637, 638, 490, 652; 206/770
See application file for complete search history.

(56) References Cited

U.S. PATENT DOCUMENTS

| | | | | |
|---|---|---|---|---|
| 5,279,237 | A * | 1/1994 | Alivizatos | 112/475.05 |
| 5,813,066 | A * | 9/1998 | Gebhard et al. | 5/655 |
| 6,038,720 | A * | 3/2000 | Matthews et al. | 5/639 |
| 6,851,143 | B1 * | 2/2005 | Matthews Brown | 5/490 |
| 6,857,150 | B1 * | 2/2005 | Matthews Brown et al. | 5/655 |
| 2004/0154104 | A1 * | 8/2004 | Brown et al. | 5/644 |
| 2004/0200004 | A1 * | 10/2004 | Matthews Brown et al. | 5/655 |
| 2005/0000023 | A1 * | 1/2005 | Brown et al. | 5/655 |
| 2005/0015883 | A1 * | 1/2005 | Bartley et al. | 5/655 |
| 2005/0076443 | A1 * | 4/2005 | Kruger, Jr. | 5/636 |
| 2005/0125902 | A1 * | 6/2005 | Matthews Brown et al. | 5/655 |

* cited by examiner

*Primary Examiner*—Robert G. Santos
(74) *Attorney, Agent, or Firm*—Townsend and Townsend and Crew LLP

(57) ABSTRACT

A pillow for holding an infant comprises a pillow body having a padded region and a well region. The padded region comprises an upper section, a lower section and two side sections that surround the well region. The padded region further comprises a cover and a fill material stuffed within the cover. The pillow body angles upward from the lower section to the upper section such that when an infant is placed onto the pillow the infant is inclined, with the infant's bottom resting in the well region and the infant's back and head resting on the upper section.

20 Claims, 2 Drawing Sheets

SUPPORT PILLOW FOR SMALL INFANTS

CROSS-REFERENCE TO RELATED APPLICATIONS

This application is a continuation of U.S. patent application Ser. No. 10/612,267, filed Jul. 1, 2003, now U.S. Pat. No. 6,857,150.

BACKGROUND OF THE INVENTION

This invention relates generally to the field of pillows. More specifically, the invention relates to pillows for holding infants.

Pillows have a wide variety of uses. For example, pillows are used almost universally when sleeping to support the head. Pillows may also be used to support other things as well. One example of such a pillow is the Boppy® support pillow, commercially available from The Boppy Company. Examples of such pillows are also described in U.S. Pat. Nos. 5,261,134 and 5,661,861, the complete disclosures of which are herein incorporated by reference. One use for these pillows is to use the open well to support a baby while sitting or to be placed around a user.

Traditionally, pillows have not been used to hold infants or new born babies. For example, traditional adult pillows are ill suited for such a task and are not recommended for use with babies. However, it may still be desirable to provide a pillow especially designed for an infant or new born baby. In this way, the caregiver may rest the baby on the pillow, thereby freeing the caregiver to perform other tasks.

BRIEF SUMMARY OF THE INVENTION

The invention provides pillows that are especially designed for small infants, including those that have been born prematurely. In one embodiment, such a pillow comprises a pillow body having a padded region and a well region. The padded region comprises an upper section, a lower section and two side sections that surround the well region. The padded region further comprises a cover and a fill material stuffed within the cover. The pillow body angles upward from the lower section to the upper section such that when an infant is placed onto the pillow the infant is inclined, with the infant's bottom resting in the well region and the infant's back and head resting on the upper section.

With this configuration, the infant is securely held face-up on the pillow. Further, the baby is inclined to help prevent reflux and easier breathing if the infant is congested.

In one aspect, the well region may comprise a piece of fabric that is disposed between the upper section, the lower section, and the two side sections. The piece of fabric somewhat deflects under the infant's weight to help secure the infant on the pillow.

In another aspect, the pillow body may angle upward from the lower section to the upper section at an angle in the range from about 9 degrees to about 15 degrees. The well region may be generally circular and have a diameter in the range from about 4 inches to about 7 inches. The lower section and the side sections may extend above the well region by a distance in the range from about 1 inch to about 3 inches to secure the infant in the well region. In a further aspect, the upper section may extend above the well region by a distance in the range from about 2 inches to about 8 inches to provide the appropriate amount of incline. Still further, the pillow body may have a length in the range from about 14 inches to about 24 inches, and a width in the range from about 8 inches to about 20 inches. Also, the well region may be positioned within about 3 inches to about 7 inches of the lower section and the side sections.

In use, the infant is placed onto the support pillow in an inclined orientation, with the infant's bottom resting in the well region and the infant's back and head resting on the upper section. Optionally, the infant may be wrapped in a blanket prior to placing the infant onto the support pillow. In some cases, the infant may also be fed while on the support pillow.

In a further aspect, the support pillow may be stored in a transparent covering having an open interior sized to receive and hold the support pillow. In one embodiment, the covering may have a bottom end, a top end with an opening, and a fastener to close the opening. In a further aspect, a pair of handles are coupled to the top end.

DETAILED DESCRIPTION OF THE INVENTION

The invention provides pillows that are especially useful with infants. The pillows may be used with infants who were born prematurely up until several months old. For instance, the pillows are particularly suited for infants weighing up to about 18 pounds or until such time that the child can push up on his or her hands or knees or roll over on their own accord, although larger pillows could be used for larger babies as well.

The pillows have a well region that is surrounded by padding that helps hold the infant in the same orientation. In a preferred orientation, the baby is placed in its back, with the baby's bottom resting in the well region. In this way, the baby is maintained in a face up orientation. Further, the pillow is inclined so that the baby's head is elevated relative to the rest of the body. This position may be beneficial to infants that suffer from reflux or other digestive problems. Such a position may also help the baby to breath easier if the baby has a cold or is otherwise congested.

Another advantage of the pillows is that they are readily portable and may be placed on a wide variety of flat surfaces. For example, the pillow may be placed on the ground in the corner of a room. This permits the baby to sleep while permitting the caregiver the opportunity to do other things in the same room while still monitoring the baby. In some cases, a blanket may be attached to the pillow. In this way, the blanket may be placed on top of, or beneath the infant while lying on the pillow. The blanket may be removably attached, such as with snaps, a hook and loop fastener material, buttons or the like, or permanently attached, such as by sewing or gluing the blanket to the pillow.

Figure 1:
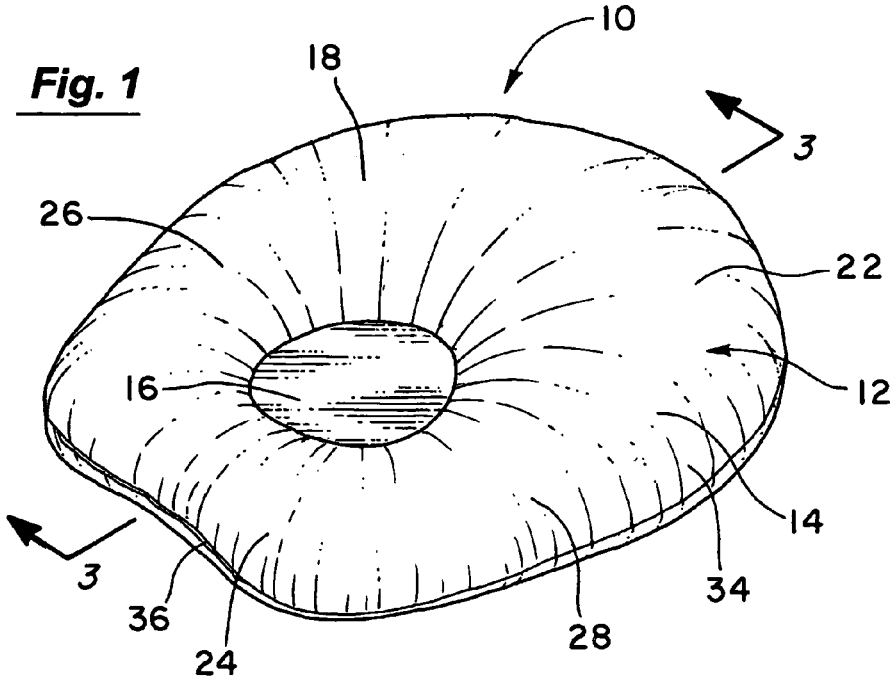
FIG. 1 is a perspective view of a pillow according to the invention.
Figure 2:
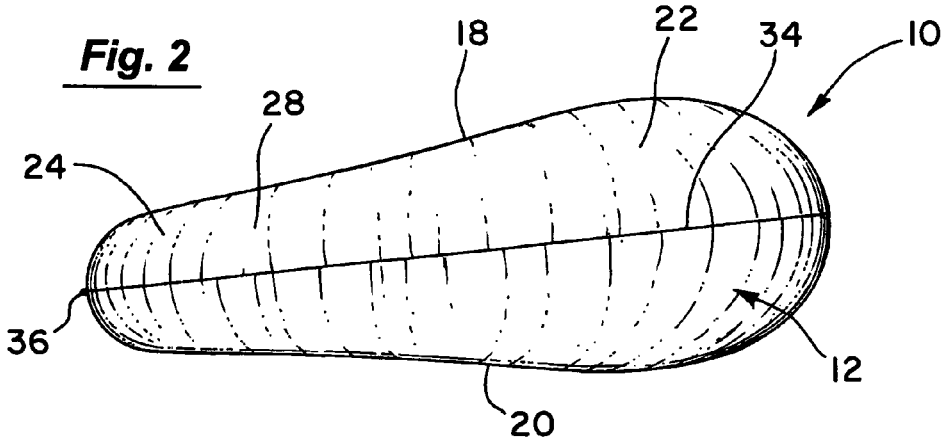
FIG. 2 is a side view of the pillow of FIG. 1.
Figure 3:
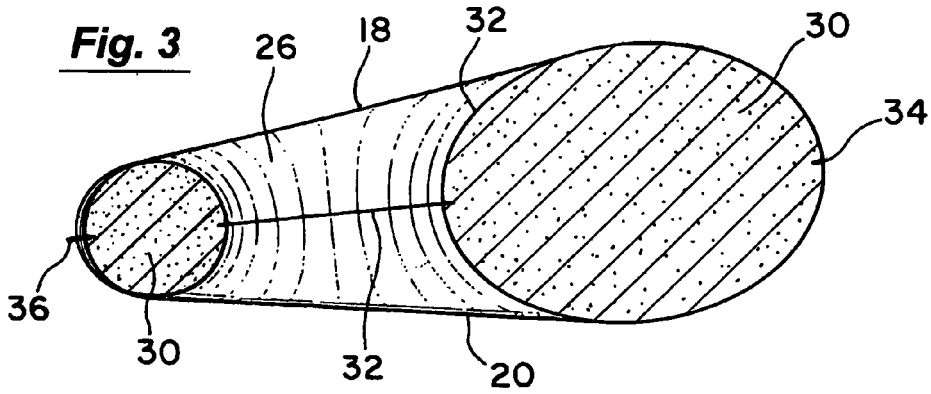
FIG. 3 is a cross sectional end view of the pillow of FIG. 1 taken along lines 3—3.

Referring now to FIGS. 1–3, one embodiment of a pillow 10 will be described. Pillow 10 comprises a pillow body 12 may generally be described in terms of a padded region 14 and a well region 16 that is surrounded by padded region 14. Pillow body 12 also includes a top side 18 and a bottom side 20. Bottom side 20 is generally flat and is designed to rest on a flat, hard surface. Top side 18 is inclined at an angle relative to bottom side 20 as described hereinafter. Pillow body 12 also includes an upper section 22, a lower section 24 and two side sections 26 and 28 that surround well region 16.

As best shown in FIG. 3, pillow 10 maybe constructed of a fill material 30 that is covered by a fabric cover 32. Examples of fill materials that may be used include resilient, compression resistant, hypoallergenic materials, such as polyester fibers, and the like. Cover 32 may be any type of fabric such as cotton, nylon, LYCRA, denim, polyester and the like. Pillow body 12 may conveniently be constructed by sewing together two pieces of fabric along a center seam 34 and around well region 16. The fill material 30 may be stuffed inside cover 32 to provide sufficient firmness so that pillow 10 generally does not sag or droop when held at one if its ends. This also provides sufficient firmness so that a baby is supported without significant deflection or indentation of pillow body 12. After stuffing the fill material within cover 32, the cover 32 may be closed by creating an exterior seam line 36. However, other techniques could be used as well. For example, a zipper could be used in place of an exterior seam. Also, the pillow could be constructed of an inflatable bladder having a fabric or padded cover.

Because of the stitching around well region 16, it does not receive any fill material. Hence, well region is formed of fabric cover 32 that extends between upper section 22, lower section 24 and side sections 26 and 28 which are stuffed with the fill material. As such, padded region 14 extends vertically above well region 16. In this way, when an infant is placed onto pillow 10, the infant's bottom will rest in well region 16, with bottom section 24 helping to prevent the infant from sliding down off the pillow. Side sections 26 and 28 help prevent the infant from moving from side to side. Upper section 22 to provides cushion and support to the infant's back and head while also placing the infant in an inclined position.

It will be appreciated that various other techniques may be used to construct pillow 10. Merely be way of example, pillow 10 may be constructed using techniques similar to those described in U.S. Pat. Nos. 5,261,134; 5,661,861; 6,038,720; 6,055,687; 6,434,770; 6,352,612; 6,279,185; 6,412,128; 6,453,493; and 6,523,200; and in copending U.S. application Ser. Nos. 10/046,377, filed Oct. 26, 2001, Ser. No. 09/884,742, filed Jun. 18, 2001, Ser. No. 09/679,139, filed Oct. 3, 2000, Ser. No. 09/802,097, filed Mar. 8, 2001, Ser. No. 10/426,067, filed Apr. 28, 2003; and Ser. No. 10/612,266, filed on the same date as the present application (entitled "Multi-Use Pillow and Methods". The complete disclosures of all these references are herein incorporated by reference. Also, the overall shape of pillow 10 may be varied. For example, as shown, the corners are rounded. However, other shapes may be used as well. The overall shape could be square, rectangular, oval, round, and the like. In one aspect, the pillow may be generally round, and may have a diameter of about 24 inches.

Pillow 10 may be constructed in a variety of sizes depending on the size of the baby. As one example, for infants ranging from about 3 pounds to about 18 pounds or until the baby can push up on their hands or knees or roll over on their own accord, pillow 10 may have a length from lower section 24 to upper section 22 that is in the range from about 14 inches to about 24 inches, and more preferably from about 17 inches to about 19 inches. Pillow 10 may have a width between side sections 26 and 28 that is in the range from about 8 inches to about 16 inches, and more preferably from about 10 inches to about 14 inches. The width of pillow 10 at upper section 22 may be in the range from about 14 inches to about 17 inches.

Well region 16 may be generally circular and have a diameter that is in the range from about 4 inches to about 7 inches, and more preferably at about 5 inches. Well region 16 may also be within about 3 inches to about 7 inches, and more preferably within about 4 inches of the outer edge of lower section 24. Well region 16 may also be within about 3 inches to about 7 inches, and more preferably within about 5 inches of the outer edges of side sections 26 and 28.

The piece of fabric disposed across well region 16 may also be positioned approximately midway between top side 18 and bottom side 20. The distance between the piece of fabric in well region 16 and top side 18 may be in the range from about 1 inch to about 3 inches, and more preferably about 2 inches. Well region 16 may be similarly distanced from bottom side 20.

The height of pillow 10 at lower section 24 may be in the range from about 2 inches to about 6 inches, and more preferably about 4 inches. The height of pillow 10 at upper section 22 may be in the range from about 5 inches to about 11 inches, and more preferably about 6 inches to about 8 inches. Also, top side 18 may be inclined relative to bottom side 20 at an angle in the range from about 3 degrees to about 28 degrees, and more preferably from about 9 degrees to about 15 degrees. Such an angle elevates the baby's head and upper torso. This orientation may help the infant with digestion and may help to prevent reflux. Also, if the baby's head is congested, it facilitates drainage of the nasal passages to make breathing easier.

Figure 4:
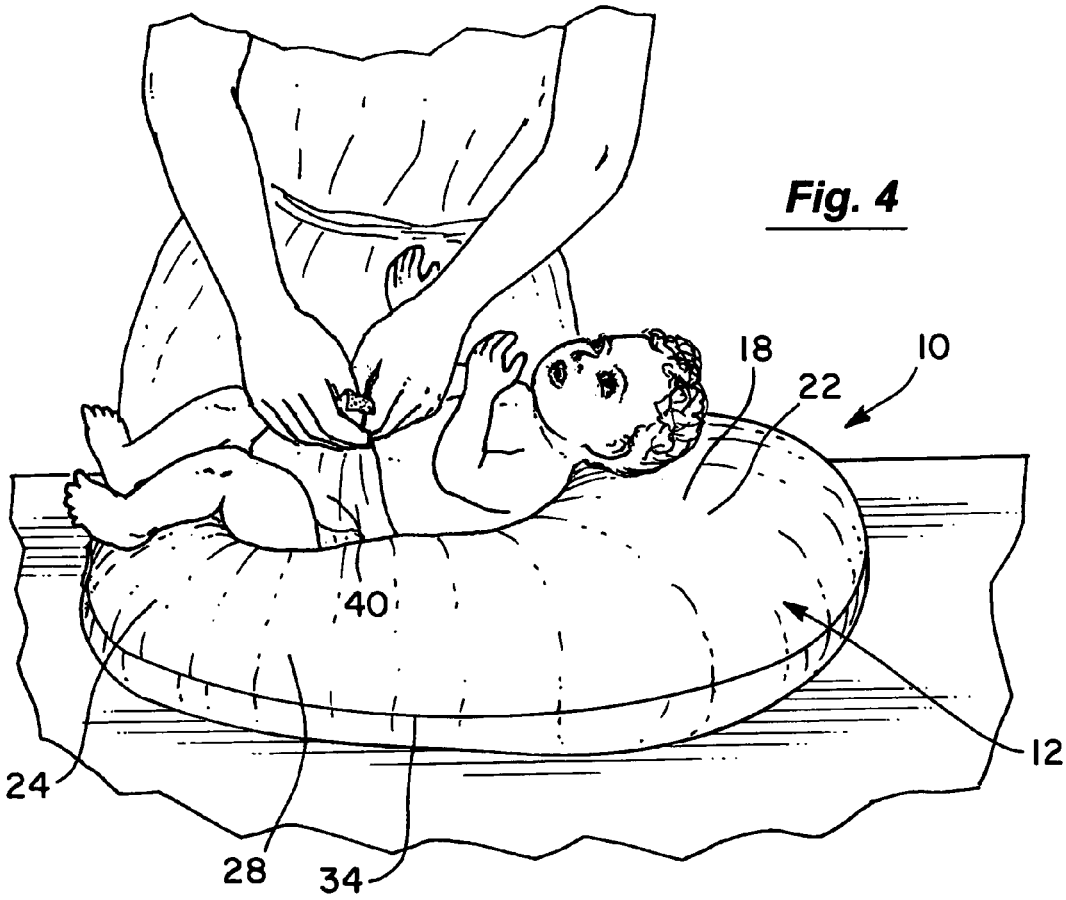
FIG. 4 illustrates an infant lying in the pillow of FIG. 1 according to the invention.

Referring to FIG. 4, placement of an infant onto pillow 10 will be described. As shown, the infant is held while changing a diaper 40. With newborns, a blanket may be wrapped around the infant before placing the infant onto pillow 10. However, it is not necessary for a blanket to be used. Also, in some cases, a baby blanket could simply be draped over pillow 10. When placed onto pillow 10, the infant's bottom rests in well region 16. The piece of fabric extending across well region 16 generally supports the weight of the infant. Because fabric is used as a seat, the infant's weight causes the fabric to slightly deflect so that the seat or "nest" is comfortable for the infant. As shown, the infant's legs are positioned on lower section 24, with the recessed well region 16 assisting to prevent the infant from sliding down. The infant's back and head rest on upper section 22 and are upwardly incline. The side sections 26 and 28 prevent the infant from moving from side to side. Hence, pillow 10 permits the infant to remain in a comfortable, yet secure orientation. The configuration of pillow 10 also give the infant a certain amount of security and support to help keep the infant calm. Besides helping to change a diaper, pillow 10 may be used to help hold the baby while sleeping, while awake, while eating, and the like.

Although not shown, it will be appreciated that other modifications may be made to pillow 10, such as by providing one or more pockets to hold items such as pacifiers, bottles, cloths and the like. Further, various attachment mechanisms, straps and the like may be coupled to pillow 10 to hold or suspend items. For instance, toy bars could be used to suspend objects over the infant as described in copending U.S. application Ser. No. 09/802,097, filed Mar. 8, 2001, the complete disclosure of which is herein incorporated by reference. Other attachments may include any of those described in the references incorporated herein. As another example, one or more handles could be coupled to the pillow to facilitate carrying of the pillow. Examples of suitable handles are described in the references incorporated herein.

Figure 5:
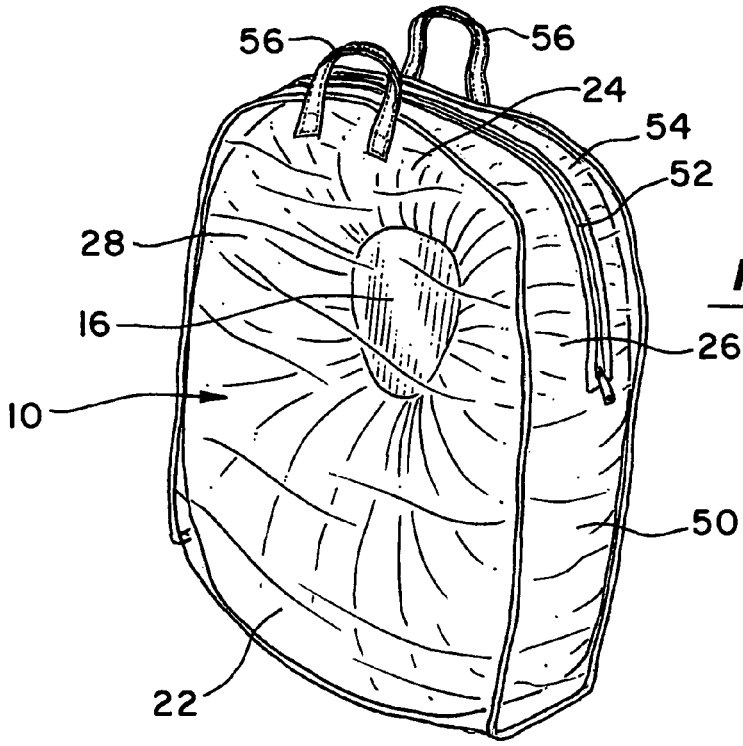
FIG. 5 illustrates the pillow of FIG. 1 held within a protective cover.

As shown in FIG. 5, pillow 10 may be stored in a protective cover 50 that may also serve as packaging for pillow 10. Cover 50 may be constructed of a transparent plastic and have a zipper 52 at a top end 54 to permit pillow 10 to be inserted into and removed from cover 50. Cover 50 may be provided with a similar shape to pillow 10 and may have handles 56 to permit it to be easily carried.

Alternatively, pillow 10 may be packaged and stored using a variety of other packing devices, purses or the like. Examples of such packages and bags are described in references incorporated herein and in copending U.S. application Ser. No. 09/884,742, filed Jun. 18, 2001, and Ser. No. 10/612,265, filed on the same date as the present application (entitled "Diaper Bag and Carrying Case", incorporated herein by reference. Pillow 10 may also be displayed using any of the techniques or devices described in U.S. Pat. No. 6,119,873 incorporated herein by reference.

The invention has now been described in detail for purposes of clarity and understanding. However, it will be appreciated that certain changes and modifications may be practiced within the scope of the appended claims.

What is claimed is:

1. A pillow for holding an infant, the pillow comprising:

a pillow body having a padded region and a well region, wherein the padded region comprises an upper section, a lower section and two side sections that surround the well region, wherein the padded region further comprises a cover and a fill material stuffed within the cover, wherein the pillow body is configured to receive an infant, with the infant's bottom resting in the well region and the infant's back and head resting on the upper section, and wherein the well region is situated between the upper section and the lower section so as to be suspended above a surface onto which the pillow body rests, and wherein the upper section has a greater height than the lower section so as to incline the infant.

2. A pillow as in claim 1, wherein the well region comprises a piece of fabric disposed between the upper section, the lower section, and the two side sections.

3. A pillow as in claim 1, wherein the pillow body angles upward from the lower section to the upper section at an angle in the range from about 9 to about 15 degrees.

4. A pillow as in claim 1, wherein the well region is generally circular and has a diameter in the range from about 4 inches to about 7 inches.

5. A pillow as in claim 1, wherein the lower section and the side sections extend above the well region by a distance in the range from about 1 inch to about 3 inches.

6. A pillow as in claim 1, wherein the upper section extends above the well region by a distance in the range from about 2 inches to about 8 inches.

7. A pillow as in claim 1, wherein the pillow body has a length in the range from about 14 inches to about 24 inches, and a width in the range from about 8 inches to about 20 inches.

8. pillow as in claim 1, wherein the well region is positioned within about 3 inches to about 7 inches of the lower section and the side sections.

9. A method for supporting an infant, the method comprising:

providing a support pillow that comprises a pillow body having a padded region and a well region, wherein the padded region comprises an upper section, a lower section and two side sections that surround the well region, wherein the pillow body angles upward from the lower section to the upper section, and wherein the well region is situated between the upper section and the lower section so as to be suspended above a surface onto which the pillow body rests;

placing an infant onto the support pillow in an inclined orientation, with the infant's bottom resting in the well region above the surface and the infant's back and head resting on the upper section.

10. A method as in claim 9, wherein the infant is inclined at an angle in the range from about 9 degrees to about 15 degrees.

11. A method as in claim 9, further comprising wrapping the infant in a blanket prior to placing the infant onto the support pillow.

12. A method as in claim 9, further comprising feeding the infant while on the support pillow.

13. A method as in claim 9, wherein the padded region further comprises a cover and a fill material stuffed within the cover, wherein the well region comprises a piece of fabric disposed between the upper section, the lower section, and the two side sections, and wherein the infant's bottom is placed onto the piece of fabric.

14. A pillow kit comprising:

a support pillow that comprises a pillow body having a padded region and a well region, wherein the padded region comprises an upper section, a lower section and two side sections that surround the well region, wherein the support pillow is configured to receive an infant, with the infant's bottom resting in the well region and the infant's back and head resting on the upper section, and wherein the well region is situated between the upper section and the lower section so as to be suspended above a surface onto which the pillow body rests, and wherein the upper section has a greater height than the lower section so as to incline the infant; and a transparent covering having an open interior sized to receive and hold the support pillow.

15. A pillow kit as in claim 14, wherein the covering has a bottom end, a top end with an opening, and a fastener to close the opening.

16. A pillow kit as in claim 15, further comprising a pair of handles coupled to the top end.

17. A pillow kit as in claim 15, wherein the covering has a shape that closely matches the shape of the support pillow.

18. A pillow kit as in claim 15, wherein the padded region further comprises a cover and a fill material stuffed within the cover, wherein the well region comprises a piece of fabric disposed between the upper section, the lower section, and the two side sections.

19. A pillow kit as in claim 15, wherein the pillow body angles at an angle in the range from about 9 degrees to about 15 degrees.

20. A pillow as in claim 15, wherein the well region is generally circular and has a diameter in the range from about 4 inches to about 7 inches.

* * * * *